US009431023B2

(12) United States Patent
Avendano et al.

(10) Patent No.: US 9,431,023 B2
(45) Date of Patent: *Aug. 30, 2016

(54) MONAURAL NOISE SUPPRESSION BASED ON COMPUTATIONAL AUDITORY SCENE ANALYSIS

(71) Applicant: Knowles Electronics, LLC, Itasca, IL (US)

(72) Inventors: Carlos Avendano, Campbell, CA (US); Jean Laroche, Santa Cruz, CA (US); Michael M. Goodwin, Scotts Valley, CA (US); Ludger Solbach, Mountain View, CA (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/859,186

(22) Filed: Apr. 9, 2013

(65) Prior Publication Data

US 2013/0231925 A1 Sep. 5, 2013

Related U.S. Application Data

(63) Continuation of application No. 12/860,043, filed on Aug. 20, 2010, now Pat. No. 8,447,596.

(60) Provisional application No. 61/363,638, filed on Jul. 12, 2010.

(51) Int. Cl.
*G10L 21/0208* (2013.01)
*G10L 21/0272* (2013.01)

(52) U.S. Cl.
CPC ..... *G10L 21/0208* (2013.01); *G10L 21/0272* (2013.01)

(58) Field of Classification Search
CPC ..... G10L 21/0208; G10L 21/0272
USPC ..... 704/224–230
See application file for complete search history.

(56) References Cited

U.S. PATENT DOCUMENTS 3,517,223 A 6/1970 Gaunt et al.
3,989,897 A 11/1976 Carver (Continued)

FOREIGN PATENT DOCUMENTS

JP 2008065090 3/2008
TW 200933609 8/2009

(Continued)

OTHER PUBLICATIONS

International Search Report and Written Opinion dated Sep. 1, 2011 in Application No. PCT/US11/37250.

(Continued)

*Primary Examiner* — Douglas Godbold
(74) *Attorney, Agent, or Firm* — Carr & Ferrell LLP

(57) ABSTRACT

The present technology provides a robust noise suppression system that may concurrently reduce noise and echo components in an acoustic signal while limiting the level of speech distortion. A time-domain acoustic signal may be received and be transformed to frequency-domain sub-band signals. Features, such as pitch, may be identified and tracked within the sub-band signals. Initial speech and noise models may be then be estimated at least in part from a probability analysis based on the tracked pitch sources. Speech and noise models may be resolved from the initial speech and noise models and noise reduction may be performed on the sub-band signals. An acoustic signal may be reconstructed from the noise-reduced sub-band signals.

16 Claims, 8 Drawing Sheets

(56) References Cited

U.S. PATENT DOCUMENTS 4,811,404 A 3/1989 Vilmur et al.
4,910,779 A 3/1990 Cooper et al.
5,012,519 A 4/1991 Adlersberg et al.
5,027,306 A 6/1991 Dattorro et al.
5,050,217 A 9/1991 Orban
5,103,229 A 4/1992 Ribner
5,335,312 A 8/1994 Mekata et al.
5,408,235 A 4/1995 Doyle et al.
5,473,702 A 12/1995 Yoshida
5,687,104 A 11/1997 Lane et al.
5,701,350 A 12/1997 Popovich
5,774,562 A 6/1998 Furuya et al.
5,796,850 A 8/1998 Shiono et al.
5,806,025 A 9/1998 Vis et al.
5,828,997 A 10/1998 Durlach et al.
5,917,921 A 6/1999 Sasaki et al.
5,950,153 A 9/1999 Ohmori et al.
5,963,651 A 10/1999 Van Veen et al.
5,974,379 A 10/1999 Hatanaka et al.
6,011,501 A 1/2000 Gong et al.
6,104,993 A 8/2000 Ashley
6,138,101 A 10/2000 Fujii
6,160,265 A 12/2000 Bacchi et al.
6,240,386 B1 5/2001 Thyssen et al.
6,289,311 B1 9/2001 Omori et al.
6,326,912 B1 12/2001 Fujimori
6,343,267 B1 1/2002 Kuhn et al.
6,377,637 B1 4/2002 Berdugo
6,377,915 B1 4/2002 Sasaki
6,381,570 B2 4/2002 Li et al.
6,453,284 B1 * 9/2002 Paschall ..... 704/208
6,480,610 B1 11/2002 Fang et al.
6,483,923 B1 11/2002 Marash
6,490,556 B1 12/2002 Graumann et al.
6,539,355 B1 3/2003 Omori et al.
6,594,367 B1 7/2003 Marash et al.
6,757,395 B1 6/2004 Fang et al.
6,876,859 B2 4/2005 Anderson et al.
6,895,375 B2 5/2005 Malah et al.
7,054,808 B2 5/2006 Yoshida
7,054,809 B1 5/2006 Gao
7,065,486 B1 * 6/2006 Thyssen ..... 704/227
7,072,834 B2 7/2006 Zhou
7,110,554 B2 9/2006 Brennan et al.
7,245,767 B2 7/2007 Moreno et al.
7,254,535 B2 * 8/2007 Kushner et al. ..... 704/226
7,257,231 B1 8/2007 Avendano et al.
7,283,956 B2 10/2007 Ashley et al.
7,343,282 B2 3/2008 Kirla et al.
7,346,176 B1 3/2008 Bernardi et al.
7,373,293 B2 5/2008 Chang et al.
7,379,866 B2 5/2008 Gao
7,461,003 B1 12/2008 Tanrikulu
7,472,059 B2 12/2008 Huang
7,516,067 B2 * 4/2009 Seltzer et al. ..... 704/226
7,539,273 B2 5/2009 Struckman
7,546,237 B2 6/2009 Nongpiur et al.
7,574,352 B2 * 8/2009 Quatieri, Jr. ..... 704/207
7,590,250 B2 9/2009 Ellis et al.
7,657,427 B2 2/2010 Jelinek
7,664,640 B2 2/2010 Webber
7,672,693 B2 3/2010 Kallio et al.
7,725,314 B2 * 5/2010 Wu et al. ..... 704/233
7,769,187 B1 8/2010 Farrar et al.
7,792,680 B2 9/2010 Iser et al.
7,813,931 B2 10/2010 Hetherington et al.
7,873,114 B2 1/2011 Lin
7,925,502 B2 * 4/2011 Droppo et al. ..... 704/226
7,957,542 B2 6/2011 Sarrukh et al.
7,986,794 B2 7/2011 Zhang
8,005,238 B2 8/2011 Tashev et al.
8,032,369 B2 10/2011 Manjunath et al.
8,046,219 B2 10/2011 Zurek et al.
8,060,363 B2 11/2011 Ramo et al.
8,078,474 B2 12/2011 Vos et al.
8,098,844 B2 1/2012 Elko
8,107,631 B2 1/2012 Merimaa et al.
8,107,656 B2 1/2012 Dreβler et al.
8,111,843 B2 2/2012 Logalbo et al.
8,112,272 B2 2/2012 Nagahama et al.
8,112,284 B2 2/2012 Kjorling et al.
8,140,331 B2 3/2012 Lou
8,155,346 B2 4/2012 Yoshizawa et al.
8,160,262 B2 4/2012 Buck et al.
8,160,265 B2 4/2012 Mao et al.
8,170,221 B2 5/2012 Christoph
8,180,062 B2 5/2012 Turku et al.
8,184,822 B2 5/2012 Carreras et al.
8,184,823 B2 5/2012 Itabashi et al.
8,190,429 B2 5/2012 Iser et al.
8,195,454 B2 6/2012 Muesch
8,204,253 B1 6/2012 Solbach
8,223,988 B2 7/2012 Wang et al.
8,249,861 B2 8/2012 Li et al.
8,271,292 B2 9/2012 Osada et al.
8,275,610 B2 9/2012 Faller et al.
8,280,730 B2 10/2012 Song et al.
8,311,817 B2 11/2012 Murgia et al.
8,359,195 B2 1/2013 Li
8,363,850 B2 1/2013 Amada
8,411,872 B2 4/2013 Stothers et al.
8,438,026 B2 5/2013 Fischer et al.
8,447,045 B1 5/2013 Laroche
8,447,596 B2 5/2013 Avendano et al.
8,473,285 B2 6/2013 Every et al.
8,473,287 B2 6/2013 Every et al.
8,526,628 B1 9/2013 Massie et al.
8,538,035 B2 9/2013 Every et al.
8,606,571 B1 12/2013 Every et al.
8,611,551 B1 12/2013 Massie et al.
8,611,552 B1 12/2013 Murgia et al.
8,682,006 B1 3/2014 Laroche et al.
8,700,391 B1 4/2014 Avendano et al.
8,761,410 B1 6/2014 Avendano et al.
8,781,137 B1 7/2014 Goodwin
8,848,935 B1 9/2014 Massie et al.
8,958,572 B1 2/2015 Solbach
9,008,329 B1 4/2015 Mandel et al.
9,143,857 B2 9/2015 Every et al.
2001/0041976 A1 11/2001 Taniguchi et al.
2001/0044719 A1 11/2001 Casey
2001/0046304 A1 11/2001 Rast
2002/0036578 A1 3/2002 Reefman
2002/0052734 A1 5/2002 Unno et al.
2002/0097884 A1 7/2002 Cairns
2002/0128839 A1 9/2002 Lindgren et al.
2002/0194159 A1 12/2002 Kamath et al.
2003/0093278 A1 5/2003 Malah
2003/0162562 A1 8/2003 Curtiss et al.
2004/0047474 A1 3/2004 Vries et al.
2004/0153313 A1 8/2004 Aubauer et al.
2005/0049857 A1 * 3/2005 Seltzer et al. ..... 704/226
2005/0069162 A1 3/2005 Haykin et al.
2005/0075866 A1 4/2005 Widrow
2005/0207583 A1 9/2005 Christoph
2005/0238238 A1 10/2005 Xu et al.
2005/0266894 A9 12/2005 Rankin
2005/0267741 A1 12/2005 Laaksonen et al.
2006/0074693 A1 4/2006 Yamashita
2006/0089836 A1 4/2006 Boillot et al.
2006/0116175 A1 6/2006 Chu
2006/0116874 A1 6/2006 Samuelsson et al.
2006/0165202 A1 7/2006 Thomas et al.
2006/0247922 A1 11/2006 Hetherington et al.
2007/0005351 A1 1/2007 Sathyendra et al.
2007/0038440 A1 2/2007 Sung et al.
2007/0041589 A1 2/2007 Patel et al.
2007/0053522 A1 3/2007 Murray et al.
2007/0055508 A1 3/2007 Zhao et al.
2007/0076896 A1 4/2007 Hosaka et al.
2007/0088544 A1 4/2007 Acero et al.
2007/0154031 A1 7/2007 Avendano et al.
2007/0253574 A1 11/2007 Soulodre
2007/0299655 A1 12/2007 Laaksonen et al.

(56) References Cited

U.S. PATENT DOCUMENTS

| | | | | |
|---|---|---|---|---|
| 2008/0019548 | A1 | 1/2008 | Avendano | |
| 2008/0147397 | A1 | 6/2008 | Konig et al. | |
| 2008/0159573 | A1 | 7/2008 | Dressler et al. | |
| 2008/0170716 | A1 | 7/2008 | Zhang | |
| 2008/0186218 | A1 | 8/2008 | Ohkuri et al. | |
| 2008/0187148 | A1 | 8/2008 | Itabashi et al. | |
| 2008/0208575 | A1 | 8/2008 | Laaksonen et al. | |
| 2008/0215344 | A1 | 9/2008 | Song et al. | |
| 2008/0228474 | A1* | 9/2008 | Huang et al. | 704/226 |
| 2008/0232607 | A1 | 9/2008 | Tashev et al. | |
| 2008/0317261 | A1 | 12/2008 | Yoshida et al. | |
| 2009/0022335 | A1 | 1/2009 | Konchitsky et al. | |
| 2009/0043570 | A1 | 2/2009 | Fukuda et al. | |
| 2009/0067642 | A1 | 3/2009 | Buck et al. | |
| 2009/0086986 | A1 | 4/2009 | Schmidt et al. | |
| 2009/0095804 | A1 | 4/2009 | Agevik et al. | |
| 2009/0112579 | A1 | 4/2009 | Li et al. | |
| 2009/0119096 | A1 | 5/2009 | Gerl et al. | |
| 2009/0129610 | A1 | 5/2009 | Kim et al. | |
| 2009/0150144 | A1 | 6/2009 | Nongpiur et al. | |
| 2009/0164212 | A1 | 6/2009 | Chan et al. | |
| 2009/0175466 | A1 | 7/2009 | Elko et al. | |
| 2009/0216526 | A1 | 8/2009 | Schmidt et al. | |
| 2009/0220107 | A1* | 9/2009 | Every | G10L 21/0208 381/94.7 |
| 2009/0228272 | A1* | 9/2009 | Herbig et al. | 704/233 |
| 2009/0238373 | A1 | 9/2009 | Klein | |
| 2009/0248403 | A1 | 10/2009 | Kinoshita et al. | |
| 2009/0287481 | A1 | 11/2009 | Paranjpe et al. | |
| 2009/0287496 | A1 | 11/2009 | Thyssen et al. | |
| 2009/0299742 | A1 | 12/2009 | Toman et al. | |
| 2009/0304203 | A1 | 12/2009 | Haykin et al. | |
| 2009/0315708 | A1 | 12/2009 | Walley et al. | |
| 2009/0323982 | A1 | 12/2009 | Solbach et al. | |
| 2010/0063807 | A1 | 3/2010 | Archibald et al. | |
| 2010/0067710 | A1 | 3/2010 | Hendriks et al. | |
| 2010/0076756 | A1 | 3/2010 | Douglas et al. | |
| 2010/0076769 | A1 | 3/2010 | Yu | |
| 2010/0082339 | A1 | 4/2010 | Konchitsky et al. | |
| 2010/0087220 | A1 | 4/2010 | Zheng et al. | |
| 2010/0094622 | A1* | 4/2010 | Cardillo et al. | 704/224 |
| 2010/0103776 | A1 | 4/2010 | Chan | |
| 2010/0158267 | A1 | 6/2010 | Thormundsson et al. | |
| 2010/0198593 | A1 | 8/2010 | Yu | |
| 2010/0223054 | A1 | 9/2010 | Nemer et al. | |
| 2010/0272275 | A1 | 10/2010 | Carreras et al. | |
| 2010/0272276 | A1 | 10/2010 | Carreras et al. | |
| 2010/0282045 | A1 | 11/2010 | Chen et al. | |
| 2010/0290636 | A1 | 11/2010 | Mao et al. | |
| 2011/0007907 | A1 | 1/2011 | Park et al. | |
| 2011/0019838 | A1 | 1/2011 | Kaulberg et al. | |
| 2011/0026734 | A1 | 2/2011 | Hetherington et al. | |
| 2011/0038489 | A1 | 2/2011 | Visser et al. | |
| 2011/0081026 | A1 | 4/2011 | Ramakrishnan et al. | |
| 2011/0099010 | A1 | 4/2011 | Zhang | |
| 2011/0099298 | A1 | 4/2011 | Chadbourne et al. | |
| 2011/0103626 | A1 | 5/2011 | Bisgaard et al. | |
| 2011/0137646 | A1 | 6/2011 | Ahgren et al. | |
| 2011/0158419 | A1 | 6/2011 | Theverapperuma et al. | |
| 2011/0164761 | A1 | 7/2011 | McCowan | |
| 2011/0169721 | A1 | 7/2011 | Bauer et al. | |
| 2011/0184732 | A1 | 7/2011 | Godavarti | |
| 2011/0191101 | A1 | 8/2011 | Uhle et al. | |
| 2011/0243344 | A1 | 10/2011 | Bakalos et al. | |
| 2011/0251704 | A1 | 10/2011 | Walsh et al. | |
| 2011/0257967 | A1 | 10/2011 | Every et al. | |
| 2011/0274291 | A1 | 11/2011 | Tashev et al. | |
| 2011/0299695 | A1 | 12/2011 | Nicholson | |
| 2011/0301948 | A1 | 12/2011 | Chen | |
| 2012/0010881 | A1 | 1/2012 | Avendano et al. | |
| 2012/0017016 | A1 | 1/2012 | Ma et al. | |
| 2012/0027218 | A1 | 2/2012 | Every et al. | |
| 2012/0093341 | A1 | 4/2012 | Kim et al. | |
| 2012/0116758 | A1 | 5/2012 | Murgia et al. | |
| 2012/0143363 | A1 | 6/2012 | Liu et al. | |
| 2012/0179461 | A1 | 7/2012 | Every et al. | |
| 2012/0198183 | A1 | 8/2012 | Wetzel et al. | |
| 2013/0066628 | A1 | 3/2013 | Takahashi | |
| 2013/0251170 | A1 | 9/2013 | Every et al. | |
| 2013/0322643 | A1 | 12/2013 | Every et al. | |

FOREIGN PATENT DOCUMENTS

| | | |
|---|---|---|
| TW | 201205560 | 2/2012 |
| TW | 201207845 | 2/2012 |
| TW | 201214418 | 4/2012 |
| TW | I466107 | 12/2014 |
| WO | WO2009035614 | 3/2009 |
| WO | WO2011137258 | 3/2011 |
| WO | WO2011133405 | 10/2011 |
| WO | WO2012009047 | 1/2012 |

OTHER PUBLICATIONS

Cisco, "Understanding How Digital T1 CAS (Robbed Bit Signaling) Works in IOS Gateways", Jan. 17, 2007, http://www.cisco.com/image/gif/paws/22444/t1-cas-ios.pdf, accessed on Apr. 3, 2012.

International Search Report and Written Opinion mailed Jul. 5, 2011 in Patent Cooperation Treaty Application No. PCT/US11/32578.

International Search Report and Written Opinion mailed Jul. 21, 2011 in Patent Cooperation Treaty Application No. PCT/US11/34373.

Goldin et al., Automatic Volume and Equalization Control in Mobile Devices, AES, 2006.

Guelou et al., Analysis of Two Structures for Combined Acoustic Echo Cancellation and Noise Reduction, IEEE, 1996.

Fazel et al., An overview of statistical pattern recognition techniques for speaker verification, IEEE, May 2011.

Sundaram et al., Discriminating two types of noise sources using cortical representation and dimension reduction technique, IEE, 2007.

Bach et al., Learning Spectral Clustering with application to spech separation, Journal of machine learning research, 2006.

Hioka et al., Estimating Direct to Reverberant energy ratio based on spatial correlation model segregating direct sound and reverberation, IEEE, Conference Mar. 14-19, 2010.

Avendano et al., Study on Dereverberation of Speech Based on Temporal Envelope Filtering, IEEE, Oct. 1996.

Park et al., Frequency Domain Acoustic Echo Suppression Based on Soft Decision, Interspeech 2009.

Tognieri et al., A comparison of the LBG,LVQ,MLP,SOM and GMM algorithms for Vector Quantisation and Clustering Analysis, 1992.

Klautau et al., Discriminative Gaussian Mixture Models a Comparison with Kernel Classifiers, ICML, 2003.

Usher et. al., Enhancement of Spatial Sound Quality a New Reverberation Extraction Audio Upmixer, IEEE, 2007.

Hoshuyama et al., "A Robust Generalized Sidelobe Canceller with a Blocking Matrix Using Leaky Adaptive Filters" 1997.

Spriet et al., "The impact of speech detection errors on the noise reduction performance of multi-channel Wiener filtering and Generalized Sidelobe Cancellation" 2005.

Hoshuyama et al., "A Robust Adaptive Beamformer for Microphone Arrays with a Blocking Matrix Using Constrained Adaptive Filters" 1999.

Herbordt et al., "Frequency-Domain Integration of Acoustic Echo Cancellation and a Generalized Sidelobe Canceller with Improved Robustness" 2002.

Office Action mailed Jun. 5, 2014 in Taiwanese Patent Application 100115214, filed Apr. 29, 2011.

Office Action mailed Oct. 30, 2014 in Korean Patent Application No. 10-2012-7027238, filed Apr. 14, 2011.

Jung et al., "Feature Extraction through the Post Processing of WFBA Based on MMSE-STSA for Robust Speech Recognition," Proceedings of the Acoustical Society of Korea Fall Conference, vol. 23, No. 2(s), pp. 39-42, Nov. 2004.

Notice of Allowance dated Nov. 7, 2014 in Taiwanese Application No. 100115214, filed Apr. 29, 2011.

(56) References Cited

OTHER PUBLICATIONS

Krini, Mohamed et al., "Model-Based Speech Enhancement," in Speech and Audio Processing in Adverse Environments; Signals and Communication Technology, edited by Hensler et al., 2008, Chapter 4, pp. 89-134.
Office Action mailed Dec. 10, 2014 in Finnish Patent Application No. 20126083, filed Apr. 14, 2011.
Lu et al., "Speech Enhancement Using Hybrid Gain Factor in Critical-Band-Wavelet-Packet Transform", Digital Signal Processing, vol. 17, Jan. 2007, pp. 172-188.
Kim et al., "Improving Speech Intelligibility in Noise Using Environment-Optimized Algorithms," IEEE Transactions on Audio, Speech, and Language Processsing, vol. 18, No. 8, Nov. 2010, pp. 2080-2090.
Sharma et al., "Rotational Linear Discriminant Analysis Technique for Dimensionality Reduction," IEEE Transactions on Knowledge and Data Engineering, vol. 20, No. 10, Oct. 2008, pp. 1336-1347.
Temko et al., "Classiciation of Acoustinc Events Using SVM-Based Clustering Schemes," Pattern Recognition 39, No. 4, 2006, pp. 682-694.
Office Action mailed Jun. 26, 2015 in South Korean Patent Application 1020127027238 filed Apr. 14, 2011.
Office Action mailed Jun. 23, 2015 in Japanese Patent Application 2013-508256 filed Apr. 28, 2011.
Office Action mailed Jun. 23, 2015 in Finnish Patent Application 20126106 filed Apr. 28, 2011.
Office Action mailed Jul. 2, 2015 in Finnish Patent Application 20126083 filed Apr. 14, 2011.
Office Action mailed Jun. 17, 2015 in Japanese Patent Application 2013-519682 filed May 19, 2011.
Office Action mailed Jun. 23, 2015 in Japanese Patent Application 2013-506188 filed Apr. 14, 2011.
3GPP2 "Enhanced Variable Rate Codec, Speech Service Options 3, 68, 70, and 73 for Wideband Spread Spectrum Digital Systems", May 2009, pp. 1-308.
3GPP2 "Selectable Mode Vocoder (SMV) Service Option for Wideband Spread Spectrum Communication Systems", Jan. 2004, pp. 1-231.
3GPP2 "Source-Controlled Variable-Rate Multimode Wideband Speech Codec (VMR-WB) Service Option 62 for Spread Spectrum Systems", Jun. 11, 2004, pp. 1-164.
3GPP "3GPP Specification 26.071 Mandatory Speech CODEC Speech Processing Functions; AMR Speech Codec; General Description", http://www.3gpp.org/ftp/Specs/html-info/26071.htm, accessed on Jan. 25, 2012.
3GPP "3GPP Specification 26.094 Mandatory Speech Codec Speech Processing Functions; Adaptive Multi-Rate (AMR) Speech Codec; Voice Activity Detector (VAD)", http://www.3gpp.org/ftp/Specs/html-info/26094.htm, accessed on Jan. 25, 2012.
3GPP "3GPP Specification 26.171 Speech Codec Speech Processing Functions; Adaptive Multi-Rate—Wideband (AMR-WB) Speech Codec; General Description", http://www.3gpp.org/ftp/Specs/html-info26171.htm, accessed on Jan. 25, 2012.
3GPP "3GPP Specification 26.194 Speech Codec Speech Processing Functions; Adaptive Multi-Rate—Wideband (AMR-WB) Speech Codec; Voice Activity Detector (VAD)" http://www.3gpp.org/ftp/Specs/html-info26194.htm, accessed on Jan. 25, 2012.
International Telecommunication Union "Coding of Speech at 8 kbit/s Using Conjugate-Structure Algebraic-code-excited Linear-prediction (CS-ACELP)", Mar. 19, 1996, pp. 1-39.
International Telecommunication Union "Coding of Speech at 8 kbit/s Using Conjugate Structure Algebraic-code-excited Linear-prediction (CS-ACELP) Annex B: A Silence Compression Scheme for G.729 Optimized for Terminals Conforming to Recommendation V.70", Nov. 8, 1996, pp. 1-23.

* cited by examiner

MONAURAL NOISE SUPPRESSION BASED ON COMPUTATIONAL AUDITORY SCENE ANALYSIS

CROSS-REFERENCE TO RELATED APPLICATIONS

This application is a continuation of U.S. patent application Ser. No. 12/860,043, (now U.S. Pat. No. 8,447,596, issued May 21, 2013), filed Aug. 20, 2010, which claims the benefit of U.S. Provisional Application Ser. No. 61/363,638, filed Jul. 12, 2010, all of which are incorporated herein by reference.

BACKGROUND OF THE INVENTION

1. Field of the Invention

The present invention relates generally to audio processing, and more particularly to processing an audio signal to suppress noise.

2. Description of Related Art

Currently, there are many methods for reducing background noise in an adverse audio environment. A stationary noise suppression system suppresses stationary noise, by either a fixed or varying number of dB. A fixed suppression system suppresses stationary or non-stationary noise by a fixed number of dB. The shortcoming of the stationary noise suppressor is that non-stationary noise will not be suppressed, whereas the shortcoming of the fixed suppression system is that it must suppress noise by a conservative level in order to avoid speech distortion at low signal-to-noise ratios (SNR).

Another form of noise suppression is dynamic noise suppression. A common type of dynamic noise suppression systems is based on SNR. The SNR may be used to determine a degree of suppression. Unfortunately, SNR by itself is not a very good predictor of speech distortion due to the presence of different noise types in the audio environment. SNR is a ratio indicating how much louder speech is then noise. However, speech may be a non-stationary signal which may constantly change and contain pauses. Typically, speech energy, over a given period of time, will include a word, a pause, a word, a pause, and so forth. Additionally, stationary and dynamic noises may be present in the audio environment. As such, it can be difficult to accurately estimate the SNR. The SNR averages all of these stationary and non-stationary speech and noise components. There is no consideration in the determination of the SNR of the characteristics of the noise signal—only the overall level of noise. In addition, the value of SNR can vary based on the mechanisms used to estimate the speech and noise, such as whether it based on local or global estimates, and whether it is instantaneous or for a given period of time.

To overcome the shortcomings of the prior art, there is a need for an improved noise suppression system for processing audio signals.

SUMMARY OF THE INVENTION

The present technology provides a robust noise suppression system that may concurrently reduce noise and echo components in an acoustic signal while limiting the level of speech distortion. An acoustic signal may be received and transformed to cochlear-domain sub-band signals. Features, such as pitch, may be identified and tracked within the sub-band signals. Initial speech and noise models may be then be estimated at least in part from a probability analysis based on the tracked pitch sources. Improved speech and noise models may be resolved from the initial speech and noise models and noise reduction may be performed on the sub-band signals. An acoustic signal may be reconstructed from the noise-reduced sub-band signals.

In an embodiment, noise reduction may be performed by executing a program stored in memory to transform an acoustic signal from the time domain to cochlea-domain sub-band signals. Multiple sources of pitch may be tracked within the sub-band signals. A speech model and one or more noise models may be generated at least in part based on the tracked pitch sources. Noise reduction may be performed on the sub-band signals based on the speech model and one or more noise models.

A system for performing noise reduction in an audio signal may include a memory, frequency analysis module, source inference module, and a modifier module. The frequency analysis module may be stored in the memory and executed by a processor to transform a time domain acoustic to cochlea domain sub-band signals. The source inference engine may be stored in the memory and executed by a processor to track multiple sources of pitch within a sub-band signal and to generate a speech model and one or more noise models based at least in part on the tracked pitch sources. The modifier module may be stored in the memory and executed by a processor to perform noise reduction on the sub-band signals based on the speech model and one or more noise models.

DETAILED DESCRIPTION OF THE INVENTION

The present technology provides a robust noise suppression system that may concurrently reduce noise and echo components in an acoustic signal while limiting the level of speech distortion. An acoustic signal may be received and transformed to cochlear-domain sub-band signals. Features, such as pitch, may be identified and tracked within the sub-band signals. Initial speech and noise models may be then be estimated at least in part from a probability analysis based on the tracked pitch sources. Improved speech and noise models may be resolved from the initial speech and noise models and noise reduction may be performed on the sub-band signals. An acoustic signal may be reconstructed from the noise-reduced sub-band signals.

Multiple pitch sources may be identified in a sub-band frame and tracked over multiple frames. Each tracked pitch source ("track") is analyzed based on several features, including pitch level, salience, and how stationary the pitch source is. Each pitch source is also compared to stored speech model information. For each track, a probability of being a target speech source is generated based on the features and comparison to the speech model information.

A track with the highest probability may be, in some cases, designated as speech and the remaining tracks are designated as noises. In some embodiments, there may be multiple speech sources, and a "target" speech may be the desired speech with other speech sources considered noise. Tracks with a probability over a certain threshold may be designated as speech. In addition, there may be a "softening" of the decision in the system. Downstream of the track probability determination, a spectrum may be constructed for each pitch track, and each track's probability may be mapped to gains through which the corresponding spectrum is added into the speech and non-stationary noise models. If the probability is high, the gain for the speech model will be 1 and the gain for the noise model will be 0, and vice versa.

The present technology may utilize any of several techniques to provide an improved noise reduction of an acoustic signal. The present technology may estimate speech and noise models based on tracked pitch sources and probabilistic analysis of the tracks. Dominant speech detection may be used to control stationary noise estimations. Models for speech, noise and transients may be resolved into speech and noise. Noise reduction may be performed by filtering sub-bands using filters based on optimal least-squares estimation or on constrained optimization. These concepts are discussed in more detail below.

Figure 1:
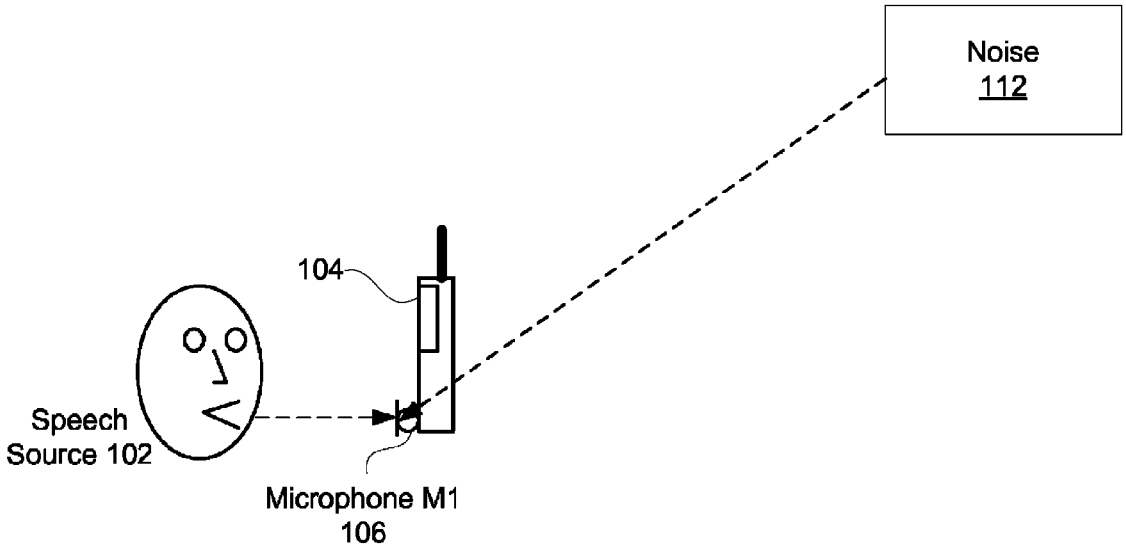
FIG. 1 is an illustration of an environment in which embodiments of the present technology may be used.

FIG. 1 is an illustration of an environment in which embodiments of the present technology may be used. A user may act as an audio (speech) source 102, hereinafter audio source 102, to an audio device 104. The exemplary audio device 104 includes a primary microphone 106. The primary microphone 106 may be omni-directional microphones. Alternatively embodiments may utilize other forms of a microphone or acoustic sensors, such as a directional microphone.

While the microphone 106 receives sound (i.e. acoustic signals) from the audio source 102, the microphone 106 also picks up noise 112. Although the noise 112 is shown coming from a single location in FIG. 1, the noise 112 may include any sounds from one or more locations that differ from the location of audio source 102, and may include reverberations and echoes. These may include sounds produced by the audio device 104 itself. The noise 112 may be stationary, non-stationary, and/or a combination of both stationary and non-stationary noise.

Acoustic signals received by microphone 106 may be tracked, for example by pitch. Features of each tracked signal may be determined and processed to estimate models for speech and noise. For example, an audio source 102 may be associated with a pitch track with a higher energy level than the noise 112 source. Processing signals received by microphone 106 is discussed in more detail below.

Figure 2:
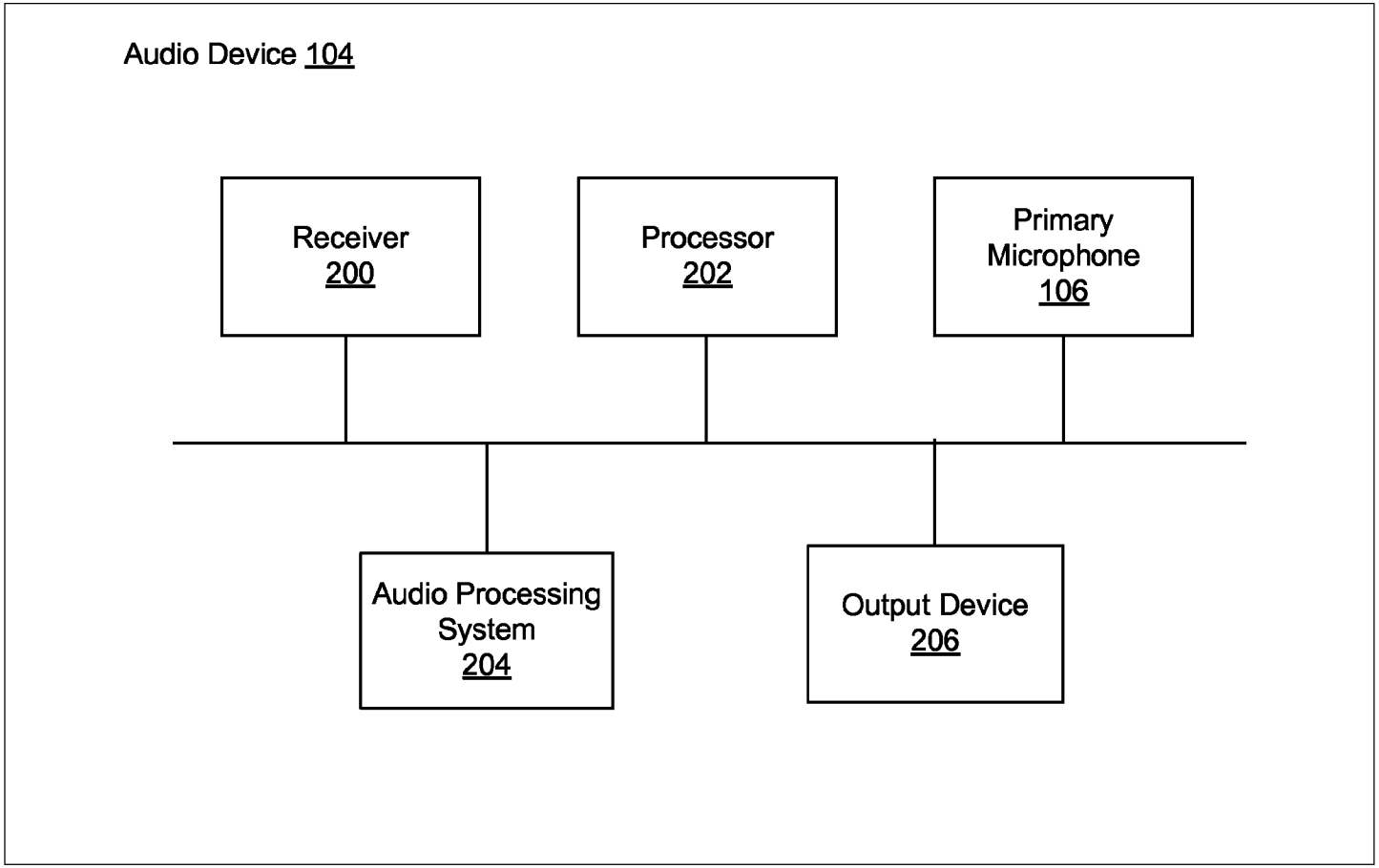
FIG. 2 is a block diagram of an exemplary audio device.

FIG. 2 is a block diagram of an exemplary audio device 104. In the illustrated embodiment, the audio device 104 includes receiver 200, processor 202, primary microphone 106, audio processing system 204, and an output device 206. The audio device 104 may include further or other components necessary for audio device 104 operations. Similarly, the audio device 104 may include fewer components that perform similar or equivalent functions to those depicted in FIG. 2.

Processor 202 may execute instructions and modules stored in a memory (not illustrated in FIG. 2) in the audio device 104 to perform functionality described herein, including noise reduction for an acoustic signal. Processor 202 may include hardware and software implemented as a processing unit, which may process floating point operations and other operations for the processor 202.

The exemplary receiver 200 may be configured to receive a signal from a communications network, such as a cellular telephone and/or data communication network. In some embodiments, the receiver 200 may include an antenna device. The signal may then be forwarded to the audio processing system 204 to reduce noise using the techniques described herein, and provide an audio signal to output device 206. The present technology may be used in one or both of the transmit and receive paths of the audio device 104.

The audio processing system 204 is configured to receive the acoustic signals from an acoustic source via the primary microphone 106 and process the acoustic signals. Processing may include performing noise reduction within an acoustic signal. The audio processing system 204 is discussed in more detail below. The acoustic signal received by primary microphone 106 may be converted into one or more electrical signals, such as, for example, a primary electrical signal and a secondary electrical signal. The electrical signal may be converted by an analog-to-digital converter (not shown) into a digital signal for processing in accordance with some embodiments. The primary acoustic signal may be processed by the audio processing system 204 to produce a signal with an improved signal-to-noise ratio.

The output device 206 is any device which provides an audio output to the user. For example, the output device 206 may include a speaker, an earpiece of a headset or handset, or a speaker on a conference device.

In various embodiments, the primary microphone is an omni-directional microphone; in other embodiments, the primary microphone is a directional microphone.

Figure 3:
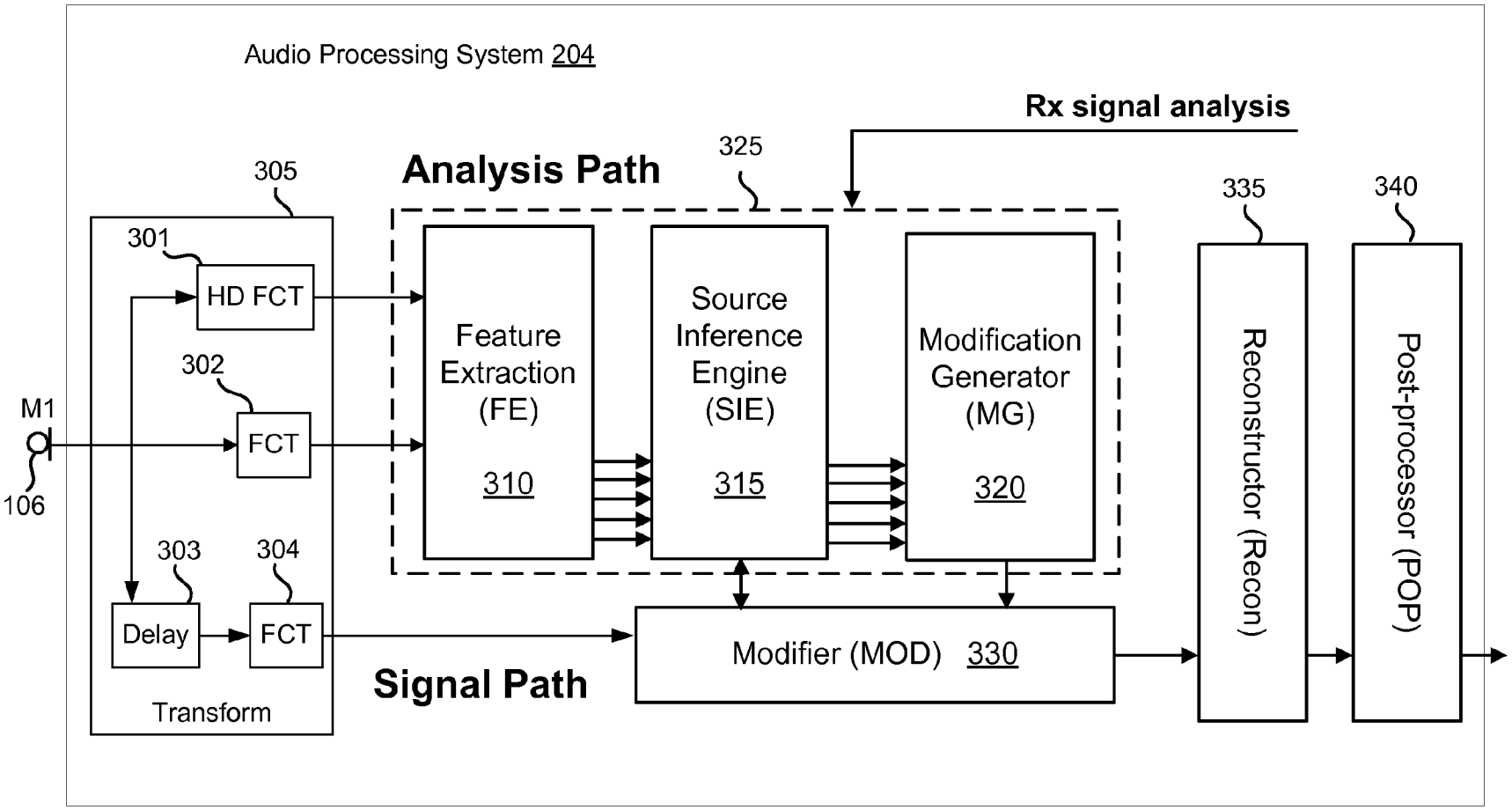
FIG. 3 is a block diagram of an exemplary audio processing system.

FIG. 3 is a block diagram of an exemplary audio processing system 204 for performing noise reduction as described herein. In exemplary embodiments, the audio processing system 204 is embodied within a memory device within audio device 104. The audio processing system 204 may include a transform module 305, a feature extraction module 310, a source inference engine 315, modification generator module 320, modifier module 330, reconstructor module 335, and post processor module 340. Audio processing system 204 may include more or fewer components than illustrated in FIG. 3, and the functionality of modules may be combined or expanded into fewer or additional modules. Exemplary lines of communication are illustrated between various modules of FIG. 3, and in other figures herein. The lines of communication are not intended to limit which modules are communicatively coupled with others, nor are they intended to limit the number of and type of signals communicated between modules.

In operation, an acoustic signal is received from the primary microphone 106, is converted to an electrical signal, and the electrical signal is processed through transform module 305. The acoustic signal may be pre-processed in the time domain before being processed by transform module 305. Time domain pre-processing may also include applying input limiter gains, speech time stretching, and filtering using an FIR or IIR filter.

The transform module 305 takes the acoustic signals and mimics the frequency analysis of the cochlea. The transform module 305 comprises a filter bank designed to simulate the frequency response of the cochlea. The transform module 305 separates the primary acoustic signal into two or more frequency sub-band signals. A sub-band signal is the result of a filtering operation on an input signal, where the bandwidth of the filter is narrower than the bandwidth of the signal received by the transform module 305. The filter bank may be implemented by a series of cascaded, complex-valued, first-order IIR filters. Alternatively, other filters or transforms such as a short-time Fourier transform (STFT), sub-band filter banks, modulated complex lapped transforms, cochlear models, wavelets, etc., can be used for the frequency analysis and synthesis. The samples of the sub-band signals may be grouped sequentially into time frames (e.g. over a predetermined period of time). For example, the length of a frame may be 4 ms, 8 ms, or some other length of time. In some embodiments, there may be no frame at all. The results may include sub-band signals in a fast cochlea transform (FCT) domain.

The analysis path 325 may be provided with an FCT domain representation 302, hereinafter FCT 302, and optionally a high-density FCT representation 301, hereinafter HD FCT 301, for improved pitch estimation and speech modeling (and system performance). A high-density FCT may be a frame of sub-bands having a higher density than the FCT 302; a HD FCT 301 may have more sub-bands than FCT 302 within a frequency range of the acoustic signal. The signal path also may be provided with an FCT representation 304, hereinafter FCT 304, after implementing a delay 303. Using the delay 303 provides the analysis path 325 with a "lookahead" latency that can be leveraged to improve the speech and noise models during subsequent stages of processing. If there is no delay, the FCT 304 for the signal path is not necessary; the output of FCT 302 in the diagram can be routed to the signal path processing as well as to the analysis path 325. In the illustrated embodiment, the lookahead delay 303 is arranged before the FCT 304. As a result, the delay is implemented in the time domain in the illustrated embodiment, thereby saving memory resources as compared with implementing the lookahead delay in the FCT-domain. In alternative embodiments, the lookahead delay may be implemented in the FCT domain, such as by delaying the output of FCT 302 and providing the delayed output to the signal path. In doing so, computational resources may be saved compared with implementing the lookahead delay in the time-domain.

The sub-band frame signals are provided from transform module 305 to an analysis path 325 sub-system and a signal path sub-system. The analysis path 325 sub-system may process the signal to identify signal features, distinguish between speech components and noise components of the sub-band signals, and generate a modification. The signal path sub-system is responsible for modifying sub-band signals of the primary acoustic signal by reducing noise in the sub-band signals. Noise reduction can include applying a modifier, such as a multiplicative gain mask generated in the analysis path 325 sub-system, or applying a filter to each sub-band. The noise reduction may reduce noise and preserve the desired speech components in the sub-band signals.

Feature extraction module 310 of the analysis path sub-system 325 receives the sub-band frame signals derived from the acoustic signal and computes features for each sub-band frame, such as pitch estimates and second-order statistics. In some embodiments, a pitch estimate may be determined by feature extraction module 310 and provided to source inference engine 315. In some embodiments, the pitch estimate may be determined by source inference engine 315. The second-order statistics (instantaneous and smoothed autocorrelations/energies) are computed in feature extraction module 310 for each sub-band signal. For the HD FCT 301, only the zero-lag autocorrelations are computed and used by the pitch estimation procedure. The zero-lag autocorrelation may be a time sequence of the previous signal multiplied by itself and averaged. For the middle FCT 302, the first-order lag autocorrelations are also computed since these may be used to generate a modification. The first-order lag autocorrelations, which may be computed by multiplying the time sequence of the previous signal with a version of itself offset by one sample, may also be used to improve the pitch estimation.

Source inference engine 315 may process the frame and sub-band second-order statistics and pitch estimates provided by feature extraction module 310 (or generated by source inference engine 315) to derive models of the noise and speech in the sub-band signals. Source inference engine 315 processes the FCT-domain energies to derive models of the pitched components of the sub-band signals, the stationary components, and the transient components. The speech, noise and optional transient models are resolved into speech and noise models. If the present technology is utilizing non-zero lookahead, source inference engine 315 is the component wherein the lookahead is leveraged. At each frame, source inference engine 315 receives a new frame of analysis path data and outputs a new frame of signal path data (which corresponds to an earlier relative time in the input signal than the analysis path data). The lookahead delay may provide time to improve discrimination of speech and noise before the sub-band signals are actually modified (in the signal path). Also, source inference engine 315 outputs a voice activity detection (VAD) signal (for each tap) that is internally fed back to the stationary noise estimator to help prevent over-estimation of the noise.

The modification generator module 320 receives models of the speech and noise as estimated by source inference engine 315. Modification generator module 320 may derive a multiplicative mask for each sub-band per frame. Modification generator module 320 may also derive a linear enhancement filter for each sub-band per frame. The enhancement filter includes a suppression backoff mechanism wherein the filter output is cross-faded with its input sub-band signals. The linear enhancement filter may be used in addition or in place of the multiplicative mask, or not used at all. The cross-fade gain is combined with the filter coefficients for the sake of efficiency. Modification generator module 320 may also generate a post-mask for applying equalization and multiband compression. Spectral conditioning may also be included in this post-mask.

The multiplicative mask may be defined as a Wiener gain. The gain may be derived based on the autocorrelation of the primary acoustic signal and an estimate of the autocorrelation of the speech (e.g. the speech model) or an estimate of the autocorrelation of the noise (e.g. the noise model). Applying the derived gain yields a minimum mean-squared error (MMSE) estimate of the clean speech signal given the noisy signal.

The linear enhancement filter is defined by a first-order Wiener filter. The filter coefficients may be derived based on the $0^{th}$ and $1^{st}$ order lag autocorrelation of the acoustic signal and an estimate of the $0^{th}$ and $1^{st}$ order lag autocorrelation of the speech or an estimate of the $0^{th}$ and $1^{st}$ order lag autocorrelation of the noise. In one embodiment, the filter coefficients are derived based on the optimal Wiener formulation using the following equations:

$$\beta_0 = \frac{(r_{xx}[0]r_{ss}[0] - r_{xx}[1]^* r_{ss}[1])}{r_{xx}[0]^2 - |r_{xx}[1]|^2}$$

-continued $$\beta_1 = \frac{(r_{xx}[0]r_{ss}[1] - r_{xx}[1]r_{ss}[0])}{r_{xx}[0]^2 - |r_{xx}[1]|^2}$$

where $r_{xx}[0]$ is the $0^{th}$ order lag autocorrelation of the input signal, $r_{xx}[1]$ is the $1^{st}$ order lag autocorrelation of the input signal, $r_{ss}[0]$ is the estimated $0^{th}$ order lag autocorrelation of the speech, and $r_{ss}[1]$ is the estimated $1^{st}$ order lag autocorrelation of the speech. In the Wiener formulations, * denotes conjugation and || denotes magnitude. In some embodiments, the filter coefficients may be derived in part based on a multiplicative mask derived as described above. The coefficient $\beta_0$ may be assigned the value of the multiplicative mask, and $\beta_1$ may be determined as the optimal value for use in conjunction with that value of $\beta_0$ according to the formula:

$$\beta_1 = \frac{(r_{ss}[1] - \beta_0 r_{xx}[1])}{r_{xx}[0]}.$$

Applying the filter yields an MMSE estimate of the clean speech signal given the noisy signal.

The values of the gain mask or filter coefficients output from modification generator module 320 are time and sub-band signal dependent and optimize noise reduction on a per sub-band basis. The noise reduction may be subject to the constraint that the speech loss distortion complies with a tolerable threshold limit.

In embodiments, the energy level of the noise component in the sub-band signal may be reduced to no less than a residual noise level, which may be fixed or slowly time-varying. In some embodiments, the residual noise level is the same for each sub-band signal, in other embodiments it may vary across sub-bands and frames. Such a noise level may be based on a lowest detected pitch level.

Modifier module 330 receives the signal path cochlear-domain samples from transform block 305 and applies a modification, such as for example a first-order FIR filter, to each sub-band signal. Modifier module 330 may also apply a multiplicative post-mask to perform such operations as equalization and multiband compression. For Rx applications, the post-mask may also include a voice equalization feature. Spectral conditioning may be included in the post-mask. Modifier module 330 may also apply speech reconstruction at the output of the filter, but prior to the post-mask.

Reconstructor module 335 may convert the modified frequency sub-band signals from the cochlea domain back into the time domain. The conversion may include applying gains and phase shifts to the modified sub-band signals and adding the resulting signals.

Reconstructor module 335 forms the time-domain system output by adding together the FCT-domain sub-band signals after optimized time delays and complex gains have been applied. The gains and delays are derived in the cochlea design process. Once conversion to the time domain is completed, the synthesized acoustic signal may be post-processed or output to a user via output device 206 and/or provided to a codec for encoding.

Post-processor module 340 may perform time-domain operations on the output of the noise reduction system. This includes comfort noise addition, automatic gain control, and output limiting. Speech time stretching may be performed as well, for example, on an Rx signal.

Comfort noise may be generated by a comfort noise generator and added to the synthesized acoustic signal prior to providing the signal to the user. Comfort noise may be a uniform constant noise not usually discernible to a listener (e.g., pink noise). This comfort noise may be added to the synthesized acoustic signal to enforce a threshold of audibility and to mask low-level non-stationary output noise components. In some embodiments, the comfort noise level may be chosen to be just above a threshold of audibility and may be settable by a user. In some embodiments, the modification generator module 320 may have access to the level of comfort noise in order to generate gain masks that will suppress the noise to a level at or below the comfort noise.

The system of FIG. 3 may process several types of signals received by an audio device. The system may be applied to acoustic signals received via one or more microphones. The system may also process signals, such as a digital Rx signal, received through an antenna or other connection.

Figure 4:
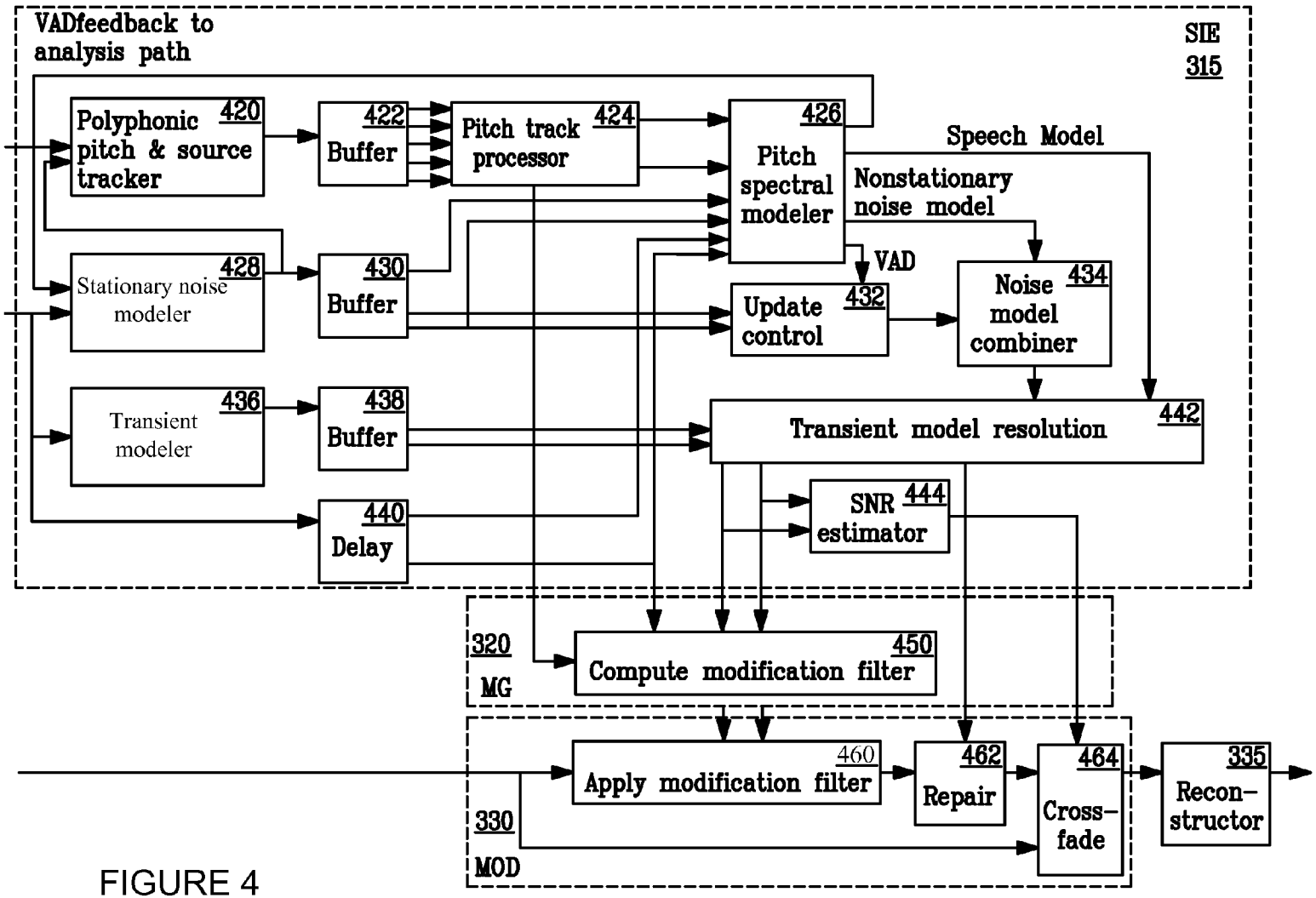
FIG. 4 is a block diagram of exemplary modules within an audio processing system.

FIG. 4 is a block diagram of exemplary modules within an audio processing system. The modules illustrated in the block diagram of FIG. 4 include source inference engine (SIE) 315, modification generator (MG) module 320, and modifier (MOD) module 330.

Source inference engine 315 receives second order statistics data from feature extraction module 310 and provides this data to polyphonic pitch and source tracker (tracker) 420, stationary noise modeler 428 and transient modeler 436. Tracker 420 receives the second order statistics and a stationary noise model and estimates pitches within the acoustic signal received by microphone 106.

Estimating the pitches may include estimating the highest level pitch, removing components corresponding to the pitch from the signal statistics, and estimating the next highest level pitch, for a number of iterations per a configurable parameter. First, for each frame, peaks may be detected in the FCT-domain spectral magnitude, which may be based on the $0^{th}$ order lag autocorrelation and may further be based on a mean subtraction such that the FCT-domain spectral magnitude has zero mean. In some embodiments, the peaks must meet a certain criteria, such as being larger than their four nearest neighbors, and must have a large enough level relative to the maximum input level. The detected peaks form the first set of pitch candidates. Subsequently, sub-pitches are added to the set for each candidate, i.e., f0/2 f0/3 f0/4, and so forth, where f0 denotes a pitch candidate. Cross correlation is then performed by adding the level of the interpolated FCT-domain spectral magnitude at harmonic points over a specific frequency range, thereby forming a score for each pitch candidate. Because the FCT-domain spectral magnitude is zero-mean over that range (due to the mean subtraction), pitch candidates are penalized if a harmonic does not correspond to an area of significant amplitude (because the zero-mean FCT-domain spectral magnitude will have negative values at such points). This ensures that frequencies below the true pitch are adequately penalized relative to the true pitch. For example, a 0.1 Hz candidate would be given a near-zero score (because it would be the sum of all FCT-domain spectral magnitude points, which is zero by construction).

The cross-correlation may then provide scores for each pitch candidate. Many candidates are very close in frequency (because of the addition of the sub-pitches f0/2 f0/3 f0/4 etc to the set of candidates). The scores of candidates close in frequency are compared, and only the best one is retained. A dynamic programming algorithm is used to select the best candidate in the current frame, given the candidates in previous frames. The dynamic programming algorithm ensures the candidate with the best score is generally selected as the primary pitch, and helps avoid octave errors.

Once the primary pitch has been chosen, the harmonic amplitudes are computed simply using the level of the interpolated FCT-domain spectral magnitude at harmonic frequencies. A basic speech model is applied to the harmonics to make sure they are consistent with a normal speech signal. Once the harmonic levels are computed, the harmonics are removed from the interpolated FCT-domain spectral magnitude to form a modified FCT-domain spectral magnitude.

The pitch detection process is repeated, using the modified FCT-domain spectral magnitude. At the end of the second iteration, the best pitch is selected, without running another dynamic programming algorithm. Its harmonics are computed, and removed from the FCT-domain spectral magnitude. The third pitch is the next best candidate, and its harmonic levels are computed on the twice-modified FCT-domain spectral magnitude. This process is continued until a configurable number of pitches has been estimated. The configurable number may be, for example, three or some other number. As a last stage, the pitch estimates are refined using the phase of the $1^{st}$ order lag autocorrelation.

A number of the estimated pitches are then tracked by the polyphonic pitch and source tracker 420. The tracking may determine changes in frequency and level of the pitch over multiple frames of the acoustic signal. In some embodiments, a subset of the estimated pitches are tracked, for example the estimated pitches having the highest energy level(s).

The output of the pitch detection algorithm consists of a number of pitch candidates. The first candidate may be continuous across frames because it is selected by the dynamic programming algorithm. The remaining candidates may be output in order of salience, and therefore may not form frequency-continuous tracks across frames. For the task of assigning types to sources (talker associated with speech or distractor associated with noise), it is important to be able to deal with pitch tracks that are continuous in time, rather than collections of candidates at each frame. This is the goal of the multi-pitch tracking step, carried out on the per-frame pitch estimates determined by the pitch detection.

Given N input candidates, the algorithm outputs N tracks, immediately reusing a track slot when the track terminates and a new one is born. At each frame the algorithm considers the N! associations of (N) existing tracks to (N) new pitch candidates. For example, if N=3, tracks 1,2,3 from the previous frame can be continued to candidates 1,2,3 in the current frame in 6 manners: (1-1,2-2,3-3), (1-1,2-3,3-2), (1-2,2-3,3-1), (1-2,2-1,3-3), (1-3,2-2,3-1), (1-3,3-2,2-1). For each of these associations, a transition probability is computed to evaluate which association is the most likely. The transition probability is computed based on how close in frequency the candidate pitch is from the track pitch, the relative candidate and track levels, and the age of the track (in frames, since its beginning). The transition probabilities tend to favor continuous pitch tracks, tracks with larger levels, and tracks that are older than other ones.

Once the N! transition probabilities are computed, the largest one is selected, and the corresponding transition is used to continue the tracks into the current frame. A track dies when its transition probability to any of the current candidates is 0 in the best association (in other words, it cannot be continued into any of the candidates). Any candidate pitch that isn't connected to an existing track forms a new track with an age of 0. The algorithm outputs the tracks, their level, and their age.

Each of the tracked pitches may be analyzed to estimate the probability of whether the tracked source is a talker or speech source The cues estimated and mapped to probabilities are level, stationarity, speech model similarity, track continuity, and pitch range.

The pitch track data is provided to buffer 422 and then to pitch track processor 424. Pitch track processor 424 may smooth the pitch tracking for consistent speech target selection. Pitch track processor 424 may also track the lowest-frequency identified pitch. The output of pitch track processor 424 is provided to pitch spectral modeler 426 and to compute modification filter module 450.

Stationary noise modeler 428 generates a model of stationary noise. The stationary noise model may be based on second order statistics as well as a voice activity detection signal received from pitch spectral modeler 426. The stationary noise model may be provided to pitch spectral modeler 426, update control module 432, and polyphonic pitch and source tracker 420. Transient modeler 436 may receive second order statistics and provide the transient noise model to transient model resolution 442 via buffer 438. The buffers 422, 430, 438, and 440 are used to account for the "lookahead" time difference between the analysis path 325 and the signal path.

Construction of the stationary noise model may involve a combined feedback and feed-forward technique based on speech dominance. For example, in one feed-forward technique, if the constructed speech and noise models indicate that the speech is dominant in a given sub-band, the stationary noise estimator is not updated for that sub-band. Rather, the stationary noise estimator is reverted to that of the previous frame. In one feedback technique, if speech (voice) is determined to be dominant in a given sub-band for a given frame, the noise estimation is rendered inactive (frozen) in that sub-band during the next frame. Hence, a decision is made in a current frame not to estimate stationary noise in a subsequent frame.

The speech dominance may be indicated by a voice activity detector (VAD) indicator computed for the current frame and used by update control module 432. The VAD may be stored in the system and used by the stationary noise modeler 428 in the subsequent frame. This dual-mode VAD prevents damage to low-level speech, especially high-frequency harmonics; this reduces the "voice muffling" effect frequently incurred in noise suppressors.

Pitch spectral modeler 426 may receive pitch track data from pitch track processor 424, a stationary noise model, a transient noise model, second orders statistics, and optionally other data and may output a speech model and a nonstationary noise model. Pitch spectral modeler 426 may also provide a VAD signal indicating whether speech is dominant in a particular sub-band and frame.

The pitch tracks (each comprising pitch, salience, level, stationarity, and speech probability) are used to construct models of the speech and noise spectra by the pitch spectral modeler 426. To construct models of the speech and noise, the pitch tracks may be reordered based on the track saliences, such that the model for the highest salience pitch track will be constructed first. An exception is that high-frequency tracks with a salience above a certain threshold are prioritized. Alternatively, the pitch tracks may be reordered based on the speech probability, such that the model for the most probable speech track will be constructed first.

In pitch spectral modeler 426, a broadband stationary noise estimate may be subtracted from the signal energy spectrum to form a modified spectrum. Next, the present system may iteratively estimate the energy spectra of the pitch tracks according to the processing order determined in the first step. An energy spectrum may be derived by estimating an amplitude for each harmonic (by sampling the modified spectrum), computing a harmonic template corresponding to the response of the cochlea to a sinusoid at the harmonic's amplitude and frequency, and accumulating the harmonic's template into the track spectral estimate. After the harmonic contributions are aggregated, the track spectrum is subtracted to form a new modified signal spectrum for the next iteration.

To compute the harmonic templates, the module uses a pre-computed approximation of the cochlea transfer function matrix. For a given sub-band, the approximation consists of a piecewise linear fit of the sub-band's frequency response where the approximation points are optimally selected from the set of sub-band center frequencies (so that sub-band indices can be stored instead of explicit frequencies).

After the harmonic spectra are iteratively estimated, each spectrum is allocated in part to the speech model and in part to the non-stationary noise model, where the extent of the allocation to the speech model is dictated by the speech probability of the corresponding track, and the extent of the allocation to the noise model is determined as an inverse of the extent of the allocation to the speech model.

Noise model combiner 434 may combine stationary noise and non-stationary noise and provide the resulting noise to transient model resolution 442. Update control 432 may determine whether or not the stationary noise estimate is to be updated in the current frame, and provide the resulting stationary noise to noise model combiner 434 to be combined with the non-stationary noise model.

Transient model resolution 442 receives a noise model, speech model, and transient model and resolves the models into speech and noise. The resolution involves verifying the speech model and noise model do not overlap, and determining whether the transient model is speech or noise. The noise and non-speech transient models are deemed noise and the speech model and transient speech are determined to be speech. The transient noise models are provided to repair module 462, and the resolved speech and noise modules are provided to SNR estimator 444 as well as the compute modification filter module 450. The speech model and the noise model are resolved to reduce cross-model leakage. The models are resolved into a consistent decomposition of the input signal into speech and noise.

SNR estimator 444 determines an estimate of the signal to noise ratio. The SNR estimate can be used to determine an adaptive level of suppression in the crossfade module 464. It can also be used to control other aspects of the system behavior. For example, the SNR may be used to adaptively change what the speech/noise model resolution does.

Compute modification filter module 450 generates a modification filter to be applied to each sub-band signal. In some embodiments, a filter such as a first-order filter is applied in each sub-band instead of a simple multiplier. Modification filter module 450 is discussed in more detail below with respect to FIG. 5.

The modification filter is applied to the sub-band signals by module 460. After applying the generated filter, portions of the sub-band signal may be repaired at repair module 462 and then linearly combined with the unmodified sub-band signal at crossfade module 464. The transient components may be repaired by module 462 and the crossfade may be performed based on the SNR provided by SNR estimator 444. The sub-bands are then reconstructed at reconstructor module 335.

Figure 5:
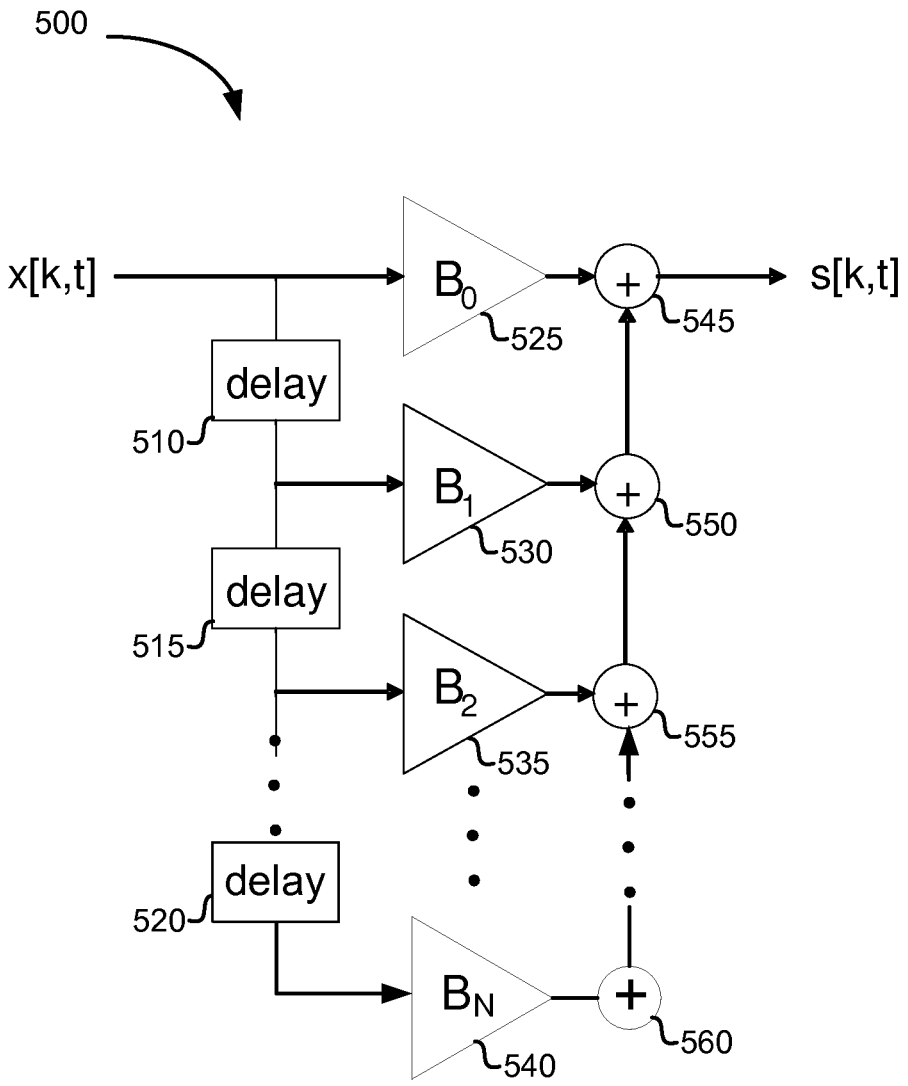
FIG. 5 is a block diagram of exemplary components within a modifier module.

FIG. 5 is a block diagram of exemplary components within a modifier module. Modifier module 500 includes delays 510, 515, and 520, multipliers 525, 530, 535, and 540 and summing modules 545, 550, 555 and 560. The multipliers 525, 530, 535, and 540 correspond to the filter coefficients for the modifier module 500. A sub-band signal for the current frame, x[k, t], is received by the modifier module 500, processed by the delays, multipliers, and summing modules, and an estimate of the speech s[k,t] is provided at the output of the final summing module 545. In the modifier module 500, noise reduction is carried out by filtering each sub-band signal, unlike previous systems which apply a scalar mask. With respect to scalar multiplication, such per-sub-band filtering allows nonuniform spectral treatment within a given sub-band; in particular this may be relevant where speech and noise components have different spectral shapes within the sub-band (as in the higher frequency sub-bands), and the spectral response within the sub-band can be optimized to preserve the speech and suppress the noise.

The filter coefficients $\beta_0$ and $\beta_1$ are computed based on speech models derived by the source inference engine 315, combined with a sub-pitch suppression mask (for example by tracking the lowest speech pitch and suppressing the sub-bands below this min pitch by reducing the $\beta_0$ and $\beta_1$ values for those sub-bands), and crossfaded based on the desired noise suppression level. In another approach, the VQOS approach is used to determine the crossfade. The $\beta_0$ and $\beta_1$ values are then subjected to interframe rate-of-change limits and interpolated across frames before being applied to the cochlear-domain signals in the modification filter. For the implementation of the delay, one sample of cochlear-domain signals (a time slice across sub-bands) is stored in the module state.

To implement a first-order modification filter, the received sub-band signal is multiplied by $\beta_0$ and also delayed by one sample. The signal at the output of the delay is multiplied by $\beta_1$. The results of the two multiplications are summed and provided as the output s[k,t]. The delay, multiplications, and summation correspond to the application of a first-order linear filter. There may be N delay-multiply-sum stages, corresponding to an Nth order filter.

When applying a first-order filter in each sub-band instead of a simple multiplier, an optimal scalar multiplier (mask) may be used in the non-delayed branch of the filter. The filter coefficient for the delayed branch may be derived to be optimal conditioned on the scalar mask. In this way, the first-order filter is able to achieve a higher-quality speech estimate than using the scalar mask alone. The system can be extended to higher orders (an N-th order filter) if desired. Also, for an N-th order filter, the autocorrelations up to lag N may be computed in feature extraction module 310 (second-order statistics). In the first-order case, the zero-th and first-order lag autocorrelations are computed. This is a distinction from prior systems which rely solely on the zero-th order lag.

Figure 6:
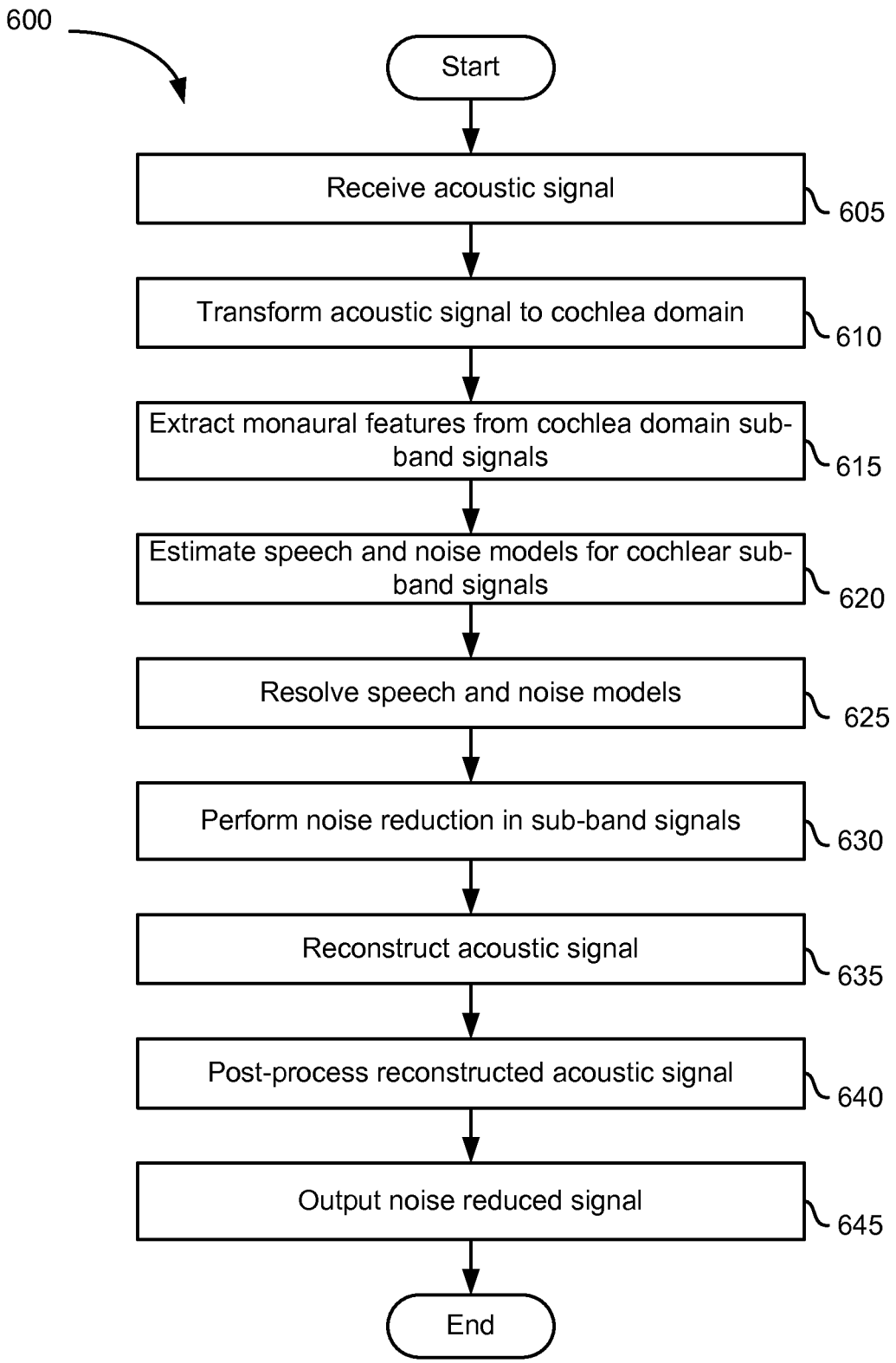
FIG. 6 is a flowchart of an exemplary method for performing noise reduction for an acoustic signal.

FIG. 6 is a flowchart of an exemplary method for performing noise reduction for an acoustic signal. First, an acoustic signal may be received at step 605. The acoustic signal may be received by microphone 106. The acoustic signal may be transformed to the cochlea domain at step 610. Transform module 305 may perform a fast cochlea transform to generate cochlea domain sub-band signals. In some embodiments, the transformation may be performed after a delay is implemented in the time domain. In such a case, there can be two cochleas, one for the analysis path 325, and one for the signal path after the time-domain delay.

Monaural features are extracted from the cochlea domain sub-band signals at step 615. The monaural features are extracted by feature extraction module 310 and may include second order statistics. Some features may include pitch, energy level, pitch salience, and other data.

Speech and noise models may be estimated for cochlea sub-bands at step 620. The speech and noise models may be estimated by source inference engine 315. Generating the speech model and noise model may include estimating a number of pitch elements for each frame, tracking a selected number of the pitch elements across frames, and selecting one of the tracked pitches as a talker based on a probabilistic analysis. The speech model is generated from the tracked talker. A non-stationary noise model may be based on the other tracked pitches and a stationary noise model may be based on extracted features provided by feature extraction module 310. Step 620 is discussed in more detail with respect to the method of FIG. 7.

The speech model and noise models may be resolved at step 625. Resolving the speech model and noise model may be performed to eliminate any cross-leakage between the two models. Step 625 is discussed in more detail with respect to the method of FIG. 8. Noise reduction may be performed on the subband signals based on the speech model and noise models at step 630. The noise reduction may include applying a first order (or Nth order) filter to each sub-band in the current frame. The filter may provide better noise reduction than simply applying a scalar gain for each sub-band. The filter may be generated in modification generator 320 and applied to the sub-band signals at step 630.

The sub-bands may be reconstructed at step 635. Reconstruction of the sub-bands may involve applying a series of delays and complex-multiply operations to the sub-band signals by reconstructor module 335. The reconstructed time-domain signal may be post-processed at step 640. Post-processing may consist of adding comfort noise, performing automatic gain control (AGC) and applying a final output limiter. The noise-reduced time-domain signal is output at step 645.

Figure 7:
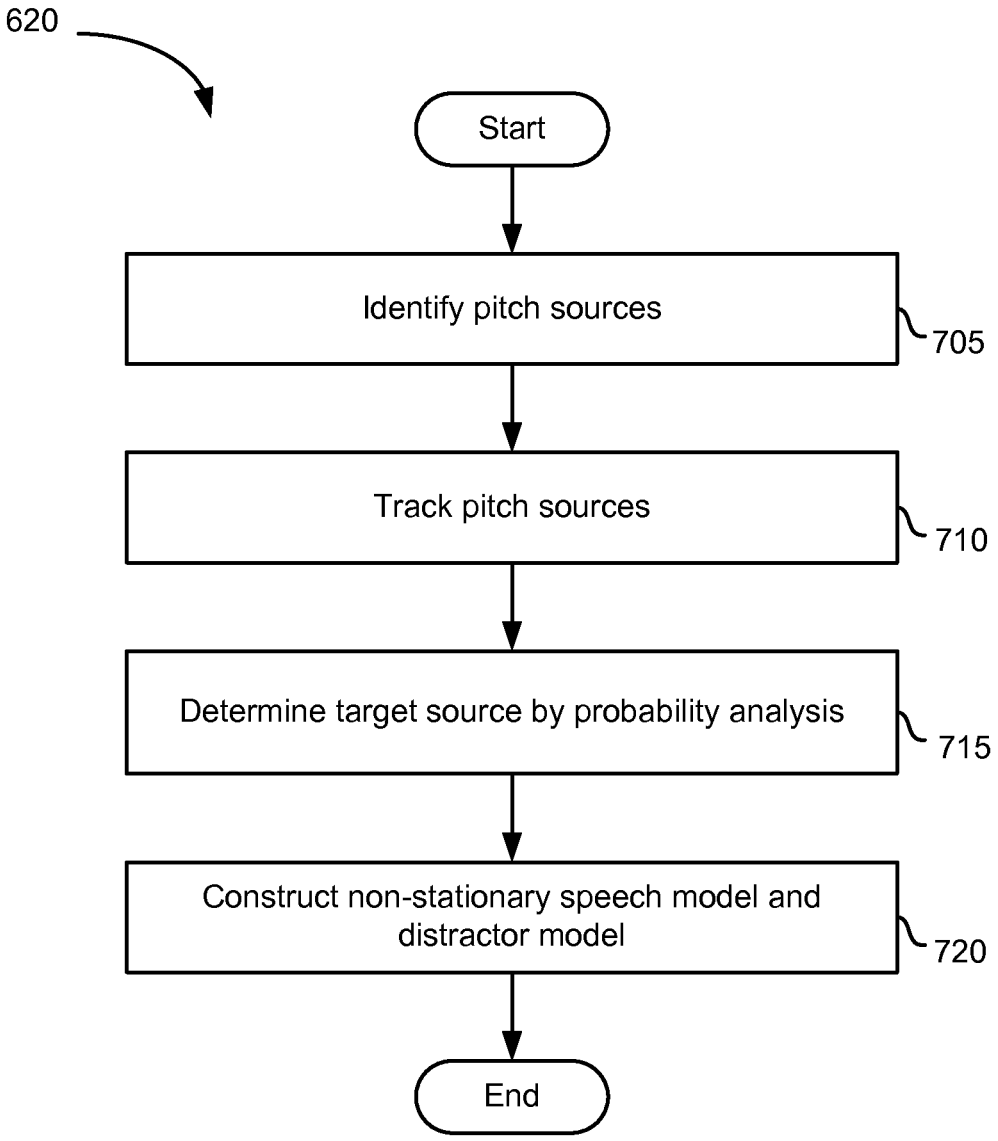
FIG. 7 is a flowchart of an exemplary method for estimating speech and noise models.

FIG. 7 is a flowchart of an exemplary method for estimating speech and noise models. The method of FIG. 7 may provide more detail for step 620 in the method of FIG. 6. First, pitch sources are identified at step 705. Polyphonic pitch and source tracker (tracker) 420 may identify pitches present within a frame. The identified pitches may be tracked across frames at step 710. The pitches may be tracked over different frames by tracker 420.

A speech source is identified by a probability analysis at step 715. The probability analysis identifies a probability that each pitch track is the desired talker based on each of several features, including level, salience, similarity to speech models, stationarity, and other features. A single probability for each pitch is determined based on the feature probabilities for that pitch, for example, by multiplying the feature probabilities. The speech source may be identified as the pitch track with the highest probability of being associated with the talker.

A speech model and noise model are constructed at step 720. The speech model is constructed in part based on the pitch track with the highest probability. The noise model is constructed based in part on the pitch tracks having a low probability of corresponding to the desired talker. Transient components identified as speech may be included in the speech model and transient components identified as non-speech transient may be included in the noise model. Both the speech model and the noise model are determined by source inference engine 315.

Figure 8:
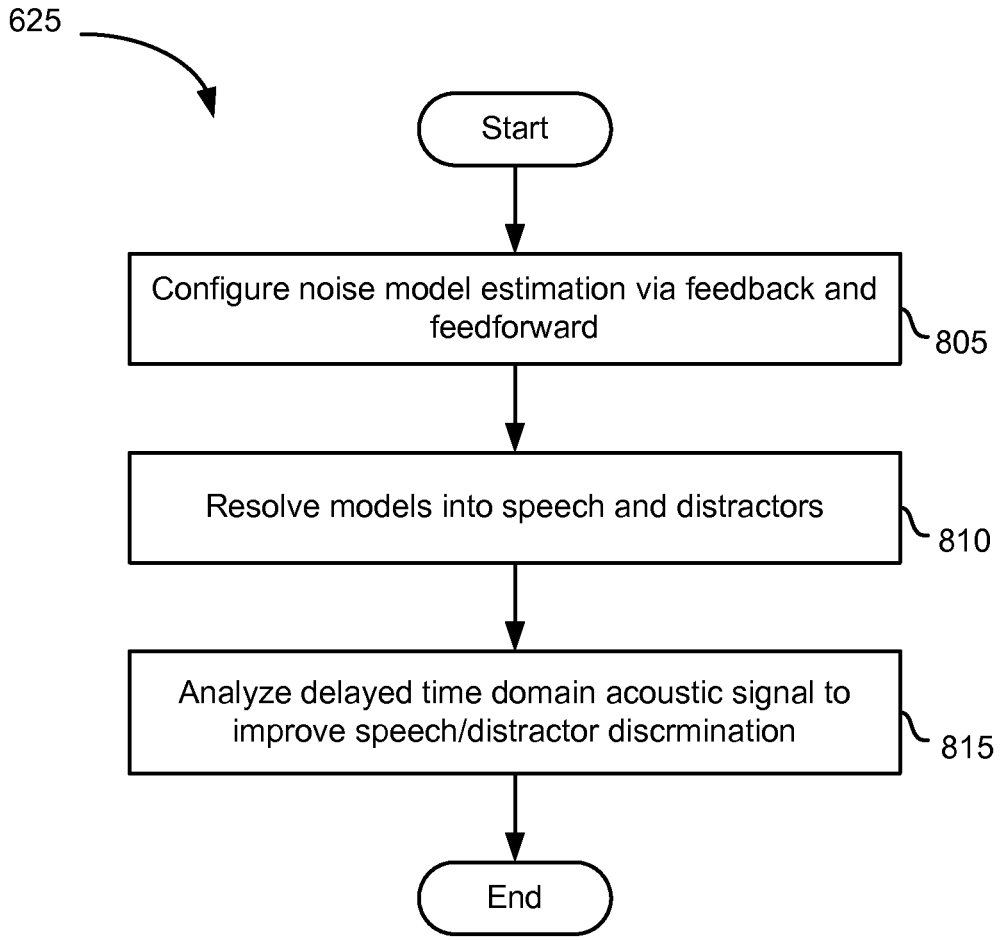
FIG. 8 is a flowchart of an exemplary method for resolving speech and noise models.

FIG. 8 is a flowchart of an exemplary method for resolving speech and noise models. A noise model estimation may be configured using feedback and feed-forward control at step 805. When a sub-band within a current frame is determined to be dominated by speech, the noise estimate from the previous frame is frozen (e.g., used in the current frame) as well as in the next frame for that sub-band.

A speech model and noise model are resolved into speech and noise at step 810. Portions of a speech model may leak into a noise model, and vice-versa. The speech and noise models are resolved such that there is no leakage between the two.

A delayed time-domain acoustic signal may be provided to the signal path to allow additional time (look-ahead) for the analysis path to discriminate between speech and noise in step 815. By utilizing a time-domain delay in the look-ahead mechanism, memory resources are saved as compared to implementing the lookahead delay in the cochlear domain.

The steps discussed in FIGS. 6-8 may be performed in a different order than that discussed, and the methods of FIGS. 4 and 5 may each include additional or fewer steps than those illustrated.

The above described modules, including those discussed with respect to FIG. 3, may include instructions stored in a storage media such as a machine readable medium (e.g., computer readable medium). These instructions may be retrieved and executed by the processor 202 to perform the functionality discussed herein. Some examples of instructions include software, program code, and firmware. Some examples of storage media include memory devices and integrated circuits.

While the present invention is disclosed by reference to the preferred embodiments and examples detailed above, it is to be understood that these examples are intended in an illustrative rather than a limiting sense. It is contemplated that modifications and combinations will readily occur to those skilled in the art, which modifications and combinations will be within the spirit of the invention and the scope of the following claims.

What is claimed is:

1. A method for performing noise reduction, the method comprising:

executing a program stored in a memory to transform a time-domain acoustic signal into a plurality of frequency-domain sub-band signals;

tracking at least one pitch from a plurality of pitch sources within a frequency-domain sub-band signal in the plurality of frequency-domain sub-band signals, wherein the tracking includes:

calculating at least one feature for each of the plurality of pitch sources; and determining, based on the at least one feature, a probability based at least in part on pitch energy level, pitch salience, and pitch stationarity for each pitch source that the pitch source is a desired speech source, the desired speech source being a speech source associated with a desired talker;

generating a speech model and one or more noise models based on the tracked at least one pitch, the speech model modeling desired speech and the one or more noise models modeling sources other than the desired speech; and performing the noise reduction on the frequency-domain sub-band signal based on the speech model and the one or more noise models.

2. The method of claim 1, wherein the tracking includes tracking the at least one pitch across successive frames of the frequency-domain sub-band signal.

3. The method of claim 1, wherein the generating a speech model and one or more noise models is based on at least two tracked pitches from the plurality of pitch sources.

4. The method of claim 1, wherein the generating a speech model and one or more noise models includes combining the multiple models.

5. The method of claim 1, wherein at least one of the one or more noise models is at least one of:

not updated for a sub-band in a current frame when speech is dominant in the previous frame; and not updated in the current frame when speech is dominant in the current frame for the sub-band.

6. The method of claim 1, wherein the noise reduction is performed using an optimal filter.

7. The method of claim 6, wherein the optimal filter is based on a least squares formulation.

8. The method of claim 1, wherein the one or more noise models model undesired speech.

9. A system for performing noise reduction in an audio signal, the system comprising:

a memory;

an analysis module stored in the memory and executed by a processor to transform a time-domain acoustic to frequency-domain sub-band signals;

a source inference engine stored in the memory and executed by the processor to track at least one pitch from a plurality of pitch sources within the frequency-domain sub-band signals and to generate a speech model and one or more noise models based on the tracked at least one pitch, the speech model modeling desired speech and the one or more noise models modeling sources other than the desired speech, wherein the tracking includes:

calculating at least one feature for each of the plurality of pitch sources; and determining, based on the at least one feature, a probability based at least in part on pitch energy level, pitch salience, and pitch stationarity for each pitch source that the pitch source is a desired speech source, the desired speech source being a speech source associated with a desired talker; and a modifier module stored in the memory and executed by the processor to perform the noise reduction on the frequency-domain sub-band signals based on the speech model and the one or more noise models.

10. The system of claim 9, wherein the source inference engine is executable to generate a speech model and one or more noise models based on at least two tracked pitches from the plurality of pitch sources.

11. The system of claim 9, wherein the source inference engine is executable to at least one of:

not update at least one of the one or more noise models for a sub-band in a current frame when speech is dominant in the previous frame; and not update at least one of the one or more noise models for the sub-band in the current frame when speech is dominant in the current frame for the sub-band.

12. The system of claim 9, wherein a modifier module is executable to apply a first-order filter to each sub-band in each frame.

13. A non-transitory computer readable storage medium having embodied thereon a program, the program being executable by a processor to perform a method for reducing noise in an audio signal, the method comprising:

transforming an acoustic signal from a time-domain signal to frequency-domain sub-band signals;

tracking at least one pitch from a plurality of pitch sources within the frequency-domain sub-band signals, the tracking including:

calculating at least one feature for each of the plurality of pitch sources; and determining, based on the at least one feature, a probability based at least in part on pitch energy level, pitch salience, and pitch stationarity for each pitch source that the pitch source is a desired speech source, the desired speech source being a speech source associated with a desired talker;

generating a speech model and one or more noise models based on the tracked at least one pitch, the speech model modeling desired speech and the one or more noise models modeling sources other than the desired speech; and performing noise reduction on the frequency-domain sub-band signals based on the speech model and one or more noise models.

14. The non-transitory computer readable storage medium of claim 13, wherein the tracking includes tracking the at least one pitch across successive frames of the frequency-domain sub-band signals.

15. The non-transitory computer readable storage medium of claim 13, wherein at least one of:

a respective one of the one or more noise models is not updated for a sub-band in a current frame when speech is dominant in the previous frame for the sub-band; and the respective one of the one or more noise models is not updated for a sub-band in a current frame when speech is dominant in the current frame for the sub-band.

16. The non-transitory computer readable storage medium of claim 13, wherein performing the noise reduction includes applying a first-order filter to each sub-band signal.

* * * * *